United States Patent [19]

Bergman

[11] 4,275,751

[45] Jun. 30, 1981

[54] COIN SORTER WITH EXPANDED CAPABILITY

[75] Inventor: Charles T. Bergman, Watertown, Wis.

[73] Assignee: Brandt, Inc., Watertown, Wis.

[21] Appl. No.: 37,494

[22] Filed: May 10, 1979

[51] Int. Cl.[3] ..... G07D 3/16

[52] U.S. Cl. ..... 133/3 C; 133/3 H; 133/8 R; 221/182

[58] Field of Search ..... 133/3 R, 3 C, 3 D, 3 H, 133/8 R; 194/102; 221/182, 186

[56] References Cited

U.S. PATENT DOCUMENTS

| | | | |
|---|---|---|---|
| 574,528 | 1/1897 | Elder et al. | 133/3 C |
| 1,378,720 | 5/1921 | Roeling et al. | 133/8 R X |
| 2,642,882 | 6/1953 | Buchholz | 133/8 R |
| 2,835,260 | 5/1958 | Buchholz | 133/8 R |
| 3,196,257 | 7/1965 | Buchholz et al. | 194/9 R X |
| 3,396,737 | 8/1968 | Picollo | 133/3 R |
| 3,680,566 | 8/1972 | Tanaka et al. | 133/3 R |
| 3,998,237 | 12/1976 | Kressin et al. | 133/8 R X |

FOREIGN PATENT DOCUMENTS

| | | | |
|---|---|---|---|
| 538892 | 1/1956 | Italy | 133/3 R |

*Primary Examiner*—F. J. Bartuska

*Attorney, Agent, or Firm*—Quarles & Brady

[57] ABSTRACT

A coin sorter has the capability to sort an additional size of coin by means of an exit chute which extends through a side of a coin hopper. A rotating pickup plate having notches for coins along its periphery rotates in an inclined plane within the hopper. Coins of certain denominations will fall through a coin opening at the apex of the rotating pickup plate and will fall into coin slots of diminishing width provided in a rotating core. The coins are held at a level peculiar to their size and are directed to discharge chutes and collection points for each denomination. Coins of the denomination which is larger than that which can pass through the coin opening are lifted from a notch by a plow positioned in front of the entrance to the exit chute and the coins travel through the chute outwardly of the hopper to a collection point. A switch actuator arm is positioned in the path of travel of the larger size coins prior to their entry into the exit chute. The apparatus may be provided as a kit of parts to convert existing sorters to handle an additional denomination of coin.

11 Claims, 6 Drawing Figures

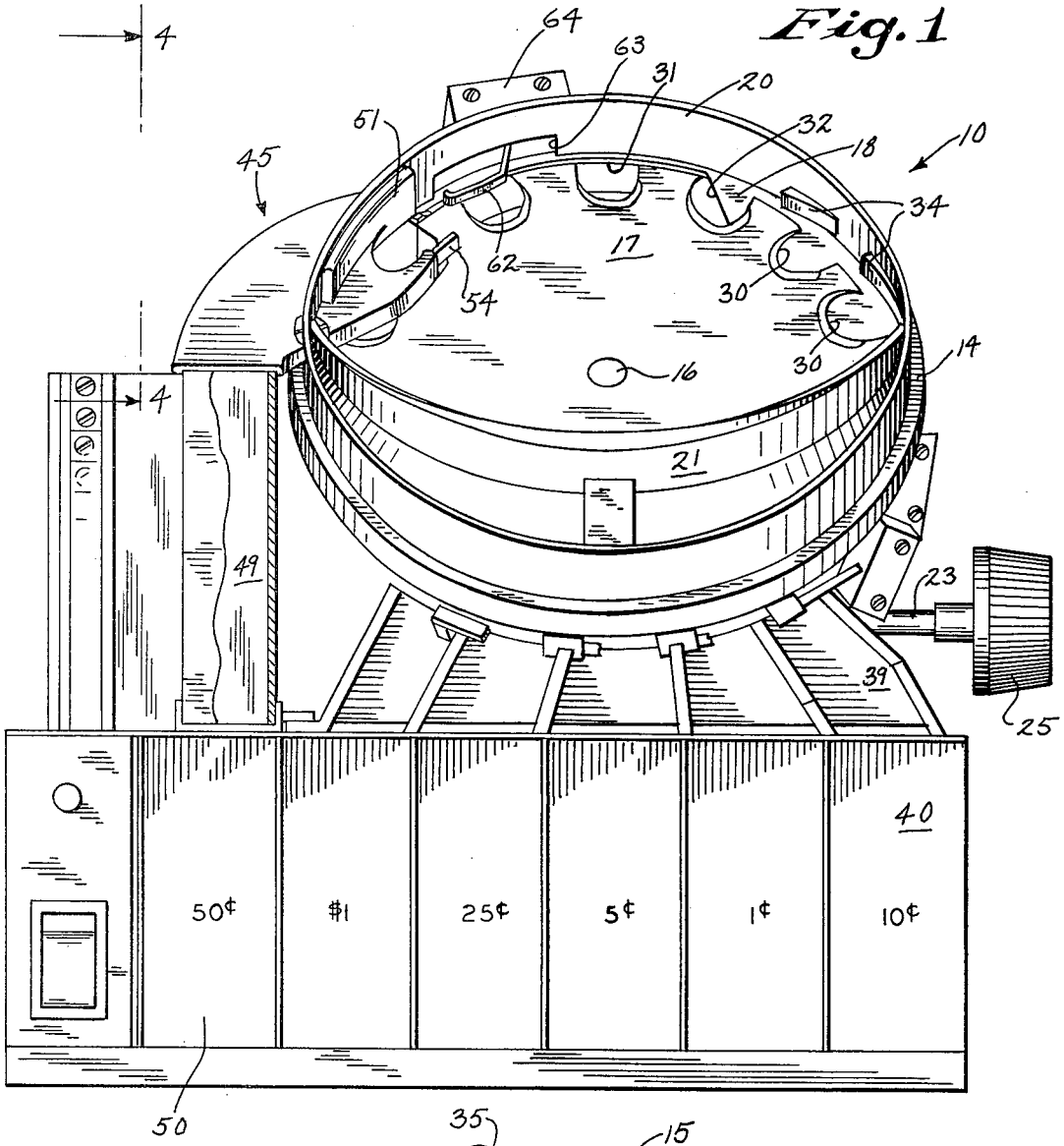
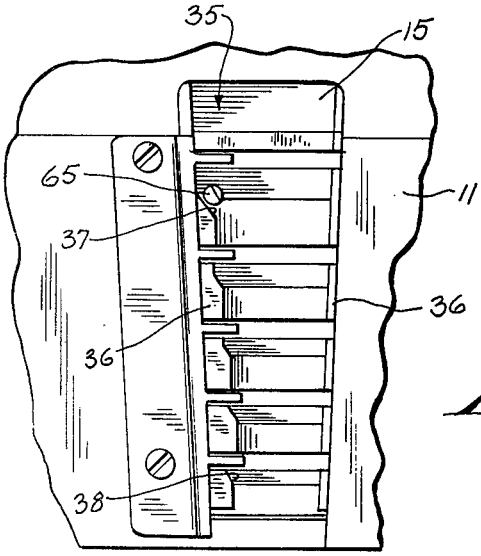
Fig. 5

COIN SORTER WITH EXPANDED CAPABILITY

TECHNICAL FIELD OF THE INVENTION

This invention relates to mechanical coin sorters, and particularly to apparatus for expanding the capability of a core-type sorter to accommodate a larger number of coin denominations.

BACKGROUND OF THE INVENTION

Mechanical coin sorters are particularly useful to sort masses of mixed coins into their respective denominations. The users of such equipment are typically those which receive larger numbers of coins as part of their normal operations, such as vending machine companies, banks and certain retail establishments. The mechanical sorters will typically not only separate a mass of mixed coins into their respective denominations, but will also count each coin of a particular denomination and keep a running tally of the count on mechanical or electronic displays.

There are two basic types of sorters in use. One type is the rail sorter in which coins are fed to the entry of an inclined rail and rolled down by gravity. At stations along the rail coins of particular denominations, as determined by their diameter, are caused to fall off or otherwise leave the rail and travel by chutes to collection and discharge points for each denomination. Examples of such rail type sorters are found in U.S. Pat. Nos. 574,528 issued Jan. 5, 1897 to Elder et al and 1,378,720 issued May 17, 1921 to Roeling et al.

The second basic type of sorter is the core sorter. In a core sorter, the coins are carried seriatim to an entry point where the coins can enter the top of one of a series of tapered sorting slots which are formed in the periphery of a truncated conical core that rotates within a fixed enclosing shell. The sorting slots are divided by a series of shelfs of diminishing size so that a coin of particular denomination, again measured by diameter, is retained at a level unique for that denomination. As the core rotates within the shell it will carry the coin past a counter mechanism and to a discharge chute for that denomination. Examples of the core type sorters are found in U.S. Pat. Nos. to Buchholz 2,642,882 issued June 23, 1953, and 2,835,260, issued May 20, 1958, and U.S. patent to Buchholz and Anderson 3,196,257, issued July 20, 1965.

The number of coins which a core-type sorter can sort is dependent upon the number of steps or shelfs which can be accommodated and are provided in each slot of the core. In the United States coin sorters of the core type have been designed to accommodate five denominations of coins (1¢, 5¢, 10¢, 25¢ and 50¢). With the advent of the new $1 coin into the United States currency system, it is necessary either to redesign the cores of core-type sorters to accommodate a sixth coin within each sorting slot or to find some other means by which all six U.S. coins can be sorted and counted. To redesign the core is a simple engineering feat but a complex and very expensive manufacturing undertaking because the tools, dies, fixtures and molds by which the cores and and shells are produced would have to be scrapped and done anew. Furthermore, redesigning the core provides no answer for converting sorters which are in the hands of users to accommodate the new sixth coin. Accordingly, to simply start over in building newly sized core-type sorters for the sixth coin is an unacceptable commercial undertaking from both the standpoint of the manufacturer and the user.

The present invention provides apparatus by which existing sorter designs can be adapted to accommodate the new $1 coin. That is, coin sorters designed for sorting and counting five denominations can be made to sort and count six denominations. Furthermore, the apparatus can be provided in the form of a kit of parts for converting previously manufactured sorters. While the apparatus has been developed as a direct response to the problems presented by a coin such as the new dollar coin which is smaller in diameter than the largest coin previously handled by a sorter, the same approach can be used for adding the capability for handling another denomination of coin of a diameter which is larger than the previously largest size handled.

SUMMARY OF THE INVENTION

According to the one aspect of the invention, there is provided a coin sorter including a hopper, an inclined rotating plate disposed in the hopper and having means at its periphery to carry coins one at a time to a coin opening adjacent the apex of the rotating plate, a rotating drum which receives coins at the coin opening and which sorts the coins into respective denominations by size, and which is characterized by an exit chute having an outlet disposed outside the hopper and having an entrance spaced above the surface of the rotating plate at a point beyond the apex of the plate and in the path of travel of coins carried thereon, and deflection means disposed in front of the entrance and adapted to lift coins of a size greater than the coin opening from the rotating plate and to direct such coins to the entrance of the exit chute.

This aspect of the invention may also include coin counting means actuated by each coin which passes the coin opening.

In accordance with another aspect of the invention, there is provided a coin sorter conversion kit having component parts capable of being assembled to a coin sorter for adding the capacity to sort and count an additional denomination of coin, which coin sorter includes a hopper, an inclined rotating plate disposed in the hopper and having means at its periphery to carry coins one at a time to a coin opening adjacent the apex of the rotating plate, a rotating drum which receives coins at the coin opening and which sorts the coins into respective denominations by size, and wherein the kit comprises an exit chute for coins of a size larger than can pass through the coin opening, said exit chute adapted to be mounted to the hopper and to extend therethrough, said exit chute having an entrance spaced above the surface of the rotating plate at a point beyond the apex of the plate and in the path of travel of coins carried thereon and deflection means adapted to be positioned in front of the entrance to lift coins of the larger size from said rotating plate and to direct the same into the entrance of the exit chute.

The conversion kit may likewise include coin counting means adapted to be mounted on the sorter with a coin sensor positioned in the path of travel of the larger size coins beyond the apex.

It is an object of the present invention to provide an apparatus by which a sorter designed to accommodate five denominations of coins can be converted with a minimum effort to one capable of sorting and counting six denominations.

It is a further object of the invention to provide a conversion kit for adapting existing coin sorters to handle an additional denomination of coin.

It is still another object to provide an off-sorting mechanism which can be mounted on a core-type sorter to accommodate the largest size of coin to sort and count the same.

The foregoing and other objects and advantages of the invention will appear in the following detailed description of the preferred embodiment in which reference is made to accompanying drawings.

BRIEF DESCRIPTION OF THE DRAWINGS

FIG. 1 is a front view in elevation of a coin sorter equipped with the apparatus of the present invention;

FIG. 5 is an enlarged view in elevation of a coin sorting slot viewed from the plane of the line 5—5 of FIG. 2.

DETAILED DESCRIPTION OF THE PREFERRED EMBODIMENT

Figure 2:
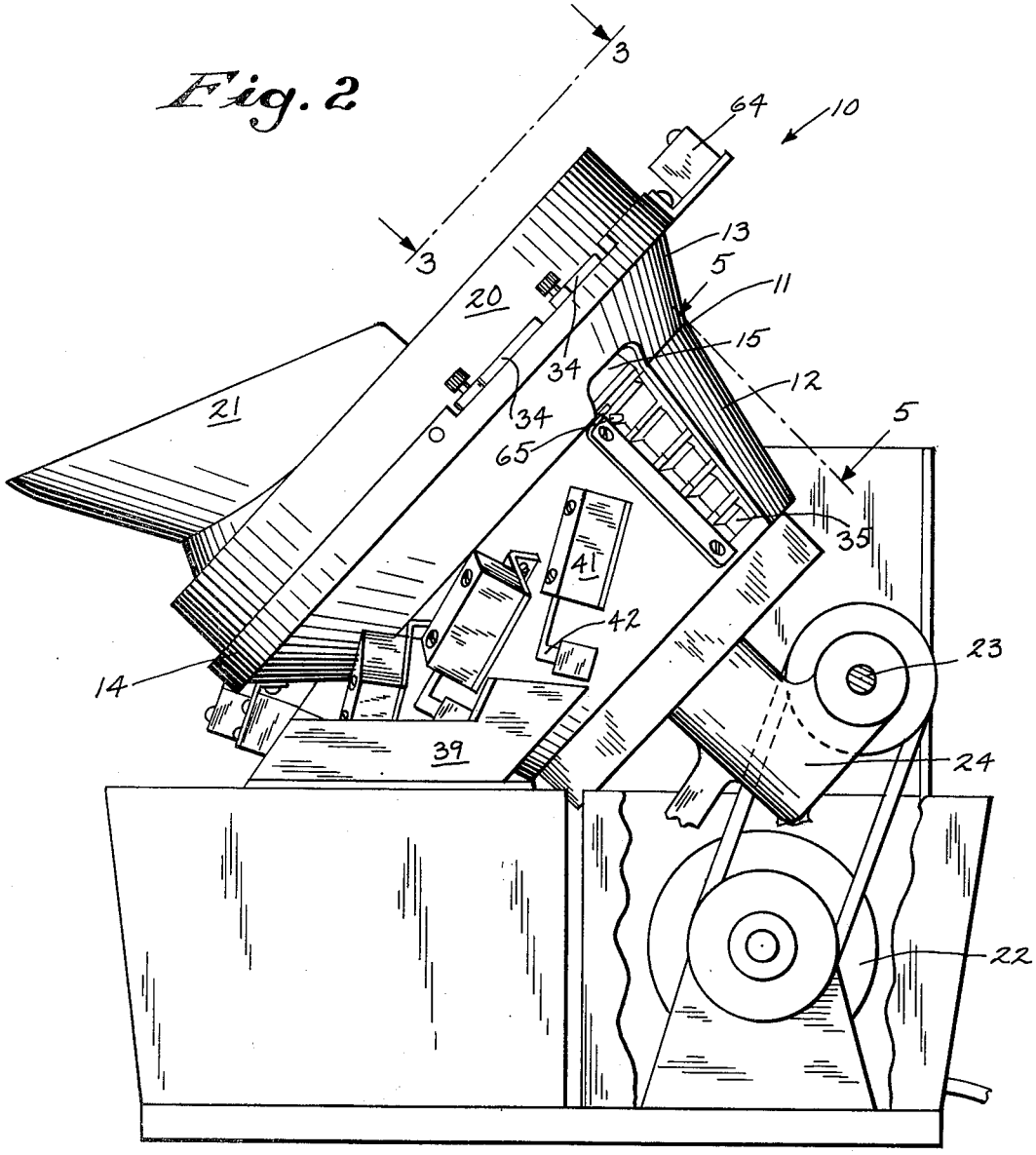
FIG. 2 is an end view in elevation of the sorter of FIG. 1 with portions broken away for purposes of illustration.
Figure 6:
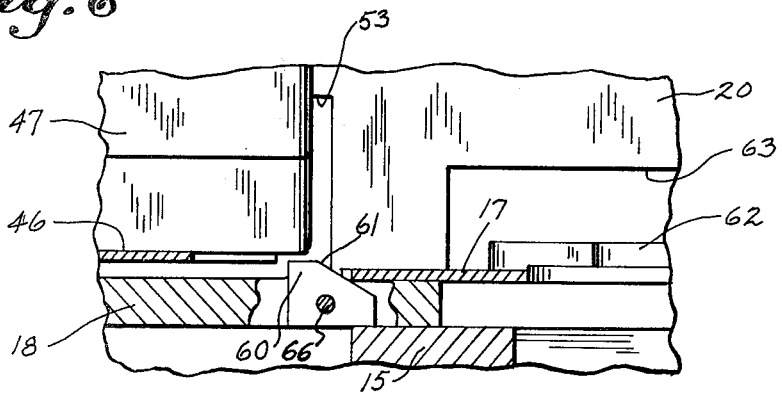
FIG. 6 is a view in section taken in the plane of the line 6—6 of FIG. 3.
Figure 3:
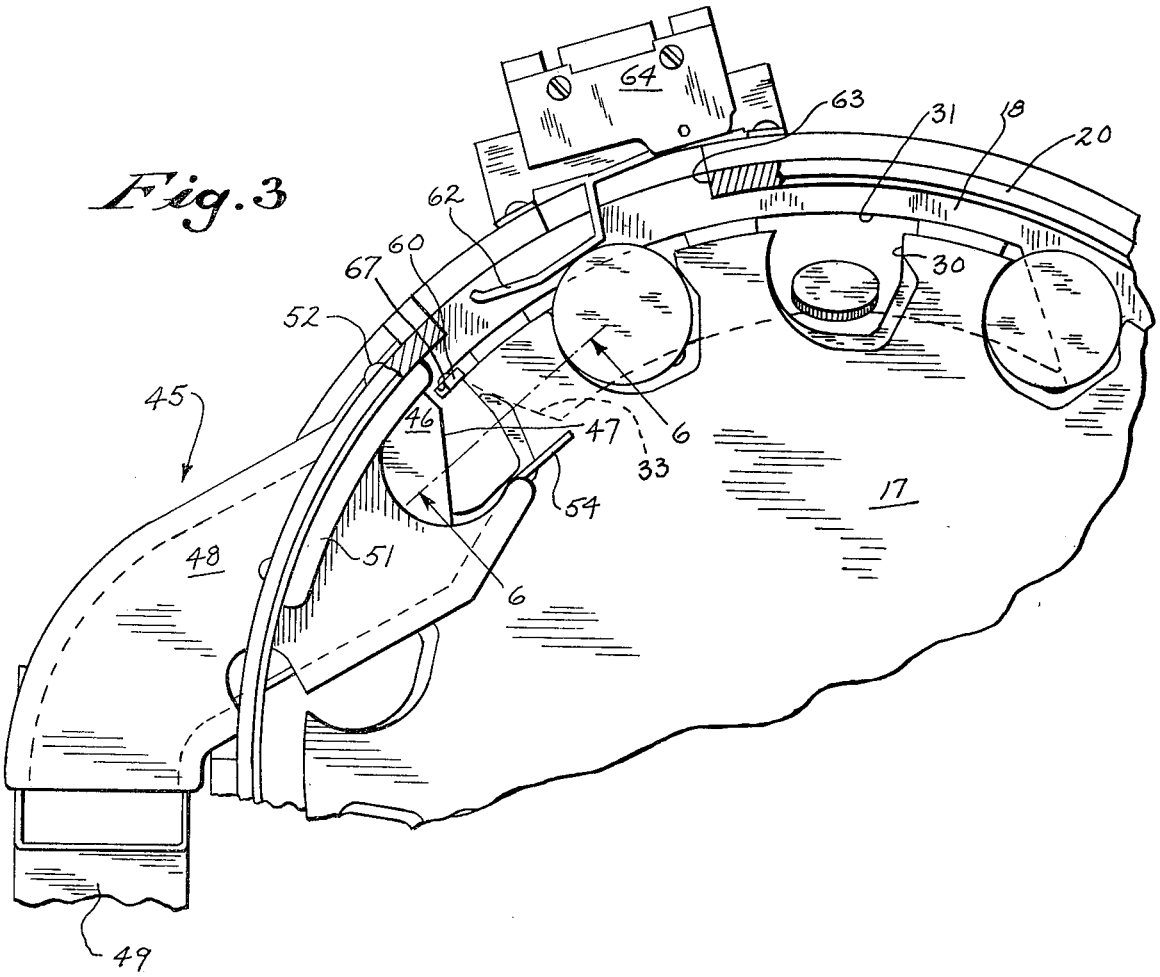
FIG. 3 is a top plan view of a portion of the sorter of FIG. 1 and viewed from the plane of the line 3—3 of FIG. 2.
Figure 4:
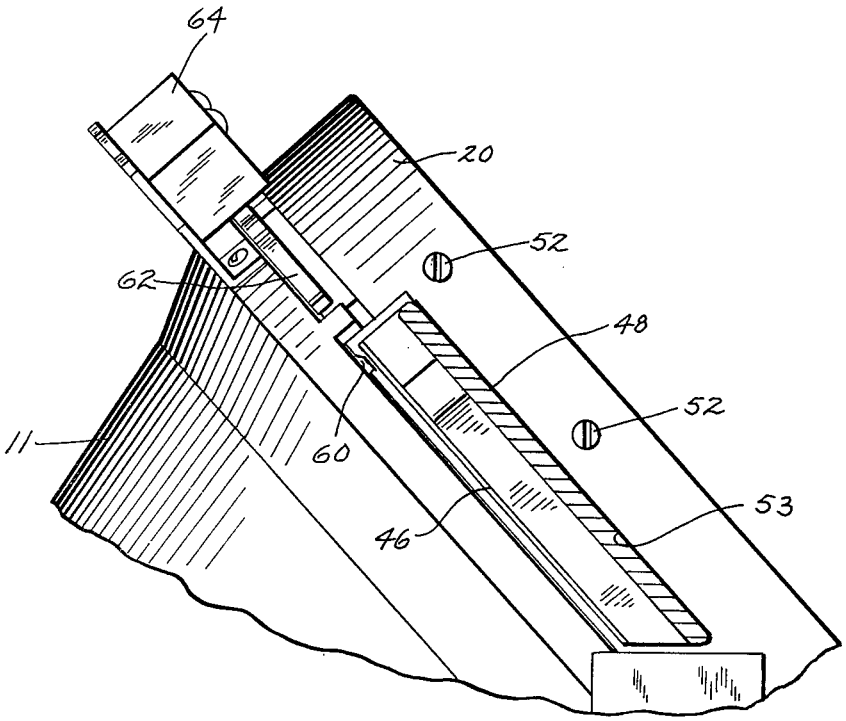
FIG. 4 is a side view of the same portion of the sorter as FIG. 3 and viewed from the plane of the line 4—4 of FIG. 1.

Referring to the drawings, the sorter 10 of the preferred embodiment illustrates the use of the apparatus of the invention to sort and count the new $1 U.S. coin which is of a size between that of a quarter and a half dollar. The sorter 10 includes a sorter shell 11 formed with a generally conical portion 12, an upper flared portion 13 and a top rim 14. Mounted for rotation within the shell 11 is a sorter core 15 which is generally conical in shape. The core 15 is mounted on a core shaft 16 which also mounts a pickup plate 17 spaced above the surface of the core. Disposed between the core and the pickup plate 17 is a stationary sorter plate 18 mounted in the shell 11.

The axis of the shaft 16 is disposed at an angle from upright so that the pickup plate 17 is inclined. The pickup plate 17 rotates through a hopper by a sorter ring 20 mounted on the rim 14 of the shell 11 and by a lip member 21 projecting outwardly of the lower portion of the sorter ring 20.

The pickup plate 17 and core 15 are rotated by the shaft 16 in a counterclockwise direction as viewed from the front, and in FIG. 1. The shaft 16 is driven by a motor 22 connected by belting to an idler shaft 23 which in turn is connected by a right angle drive 24 to the shaft 16. A handle 25 is attached to an extension of the idler shaft 23 to allow for manual rotation of the pickup plate 17 and core 15 in the case of jams.

Coins deposited in the hopper formed at the front of the sorter will be carried upwardly one at a time within notches 30 formed in the perimeter of the pickup plate 17. The notches 30 are each sized to accommodate the largest coin to be sorted. A single coin disposed in a notch 30 is carried by the pickup plate 17 over the surface of the sorter plate 18 until the coin reaches a coin opening 31 extending upon the upper area of the sorter plate 18 at the apex of the pickup plate 17. The coin opening 31 is of a uniform radial width and extends along the arc of a circle centered at the shaft 16 from a leading edge 32 to a trailing edge 33. Coin agitators 34 extend through the wall of the sorter ring 20 and are spring biased towards the perimeter of the pickup plate 17. These agitators 34 assist in assuring that only one coin will be carried up in each notch 30. When coins are carried by the pickup plate 17 to the coin opening 31, all coins of a diameter less than the radial width of the coin opening 31 will fall through the opening 31 and find their way into one of a series of coin sorting slots 35 formed about the periphery of the core 15.

The sorting slots 35 are defined by a series of spaced sorting elements 36 which each contain a series of projecting ledges or shelves on one surface. The projecting ledges 37 of each element 36 define with the adjacent sorting element a series of graduated stops of diminishing width for arresting coins of different denominations. The widest opening is at the top and the opening decreases in size towards the bottom of the core. As illustrated in FIG. 5, in which a sorting slot 35 is viewed through an opening in the shell 11 that is normally covered by a door, a top shelf 37 arrests the largest diameter coin (typically, a half dollar) while the lowest shelf 38 arrests a dime.

As the core 15 revolves within the shell 11, coins dropping into the sorting slots 35 are caught by one or the other of the shelves depending on their denomination and are held at the particular level for that denomination. In a known manner, an outlet is provided in the shell 11 at each level so that coins in the slots 35 will be carried by the core 15 to a respective outlet where a deflector will lift the sorted coin out of its sorting slot 35 and permit it to fall into a respective discharge chute. In the drawings, a typical discharge chute for the dime is identified by the reference numeral 39, and the chute leads to a drawer 40 for collecting sorted dimes. Just before a coin of any particular denomination reaches the outlet for that denomination, it will trip the actuator arm of a microswitch for the respective denomination. The dime switch 41 with its actuator arm 42 is typical. Each actuation of the microswitches can be recorded on a mechanical or electronic counter (not shown).

What has been described thus far does not differ from existing core-type coin sorters. Such sorters have typically been designed in the United States to accommodate the five common denominations of coins and the coin slots 35 have been sized to trap the 50¢ piece at its upper level, followed by the 25¢ piece, the nickel, penny and dime, in that descending order. The notches 30 on the pickup plate 17 have also been sized to accommodate the 50¢ piece, and the coin opening 31 in the sorter plate 18 has been of a radial width sufficient to allow the passage of the 50¢ piece.

With the advent of the new, smaller dollar coin, an attempt to use the existing core sorter will result in missorting and serious jamming which could severely damage the sorter. Since the new dollar coin is smaller than the 50¢ piece it will fall through the coin opening 31 and into the sorting slots 35 where it will settle between levels because of its size.

To accommodate this new sixth denomination of coin, apparatus is provided to sort the largest size coin outside the core 15. Specifically, an exit chute assembly 45 is mounted beyond the apex of the pickup plate 17 and coins of the largest size which are carried in the notches 30 of the pickup plate 17 are carried beyond the coin opening 31 of the sorter plate 18 to the exit chute assembly 45 for sorting off of the pickup plate 17. The exit chute assembly 45 includes a relatively thin exit chute bottom plate 46 which is disposed slightly above and parallel to the upper surface of the pickup plate 17. The chute bottom 46 has a leading edge which is disposed in the path of travel of coins in the notches 30 in the pickup plate 17 and which defines an entrance 47 for the exit chute. The chute bottom 46 is attached to an exit chute housing 48 including a top and depending sides which together with the bottom define an enclosed path through which coins will travel after leaving the pickup plate 17. The exit chute 45 empties into a discharge chute 49 which leads to a drawer 50 for collecting off-sorted 50¢ pieces. The chute housing 48 also includes an upstanding mounting flange 51 which is attached by screws 52 to the inner surface of the sorter ring 20. The sorter ring is provided with a cutout 53 to accommodate the chute assembly 45 which extends through the sorter ring 20. The exit chute assembly 45 is completed by a wear strip 54 disposed along the inner surface of the lower side of the chute housing 48 and projecting forwardly therefrom. The wear strip 54 is disposed along the surface of contact which a coin will make after being removed from the pickup plate 17 and being deposited into the exit chute 45.

To accommodate the new $1 coin it is also necessary to replace the original sorting plate of the sorter with a new replacement sorter plate which has a coin opening whose radial width is less than the diameter of the 50¢ piece but greater than the diameter of the new $1 coin. Then, 50¢ pieces held in a notch 30 in the pickup plate 17 will be carried past the coin opening 31 and to the entrance 47 of the exit chute 45. To insure that the large size coins which pass the coin opening 31 will be moved into the exit chute 45, a plow 60 having an inclined ramp surface 61 is mounted by a screw 66 on the sorter plate 18 in a slot 67 provided for that purpose. The slot 67 is disposed at the end of the trailing edge 33 of the coin opening so that the ramp surface is positioned at a point just prior to the entrance 47 and at the trailing edge 33. The ramp surface 61 extends from a level beneath this top surface of the pickup plate 17 to a point above the surface of the pickup plate. The large size coins which pass the coin opening 31 without falling through will engage the ramp surface 61 of the plow 60 and be lifted from the respective notch 30. The lifting action caused by the plow 60 will direct the coins into the exit chute 45.

Coins of the largest diameter which pass the apex of the pickup plate 17 and which are moving in the direction of delivery to the exit chute 45 are sensed and counted by a switch actuator arm 62 which is disposed in the path of travel of coins of the largest diameter as they are held in the notches 30. The switch actuator arm 62 projects through a cutout 63 provided in the ring 20 and operates a microswitch 64 which is attached to the outer surface of the rim 14 of the shell. The actuation of the microswitch 64 can trigger the accumulation of the count of coins of the largest diameter, in a known manner.

The final modification which is necessary to accommodate the new $1 coin is to change the dimension of the widest shelf in each sorting slot 35. This is accomplished by mounting a pin 65 adjacent the existing top shelf 37 of each sorting slot (see FIG. 5). The pin 65 is positioned to define a slot width of the proper dimension to retain the $1coin at the highest level of the slot.

The apparatus of the invention may be employed in the manufacture of new coin sorters to accommodate the new $1 coin. Furthermore, the invention may be employed as a conversion kit of parts which permits expanding the capacity of existing coin sorters already in the hands of users. The conversion kit would include the exit chute assembly 45, the additional microswitch 64, a new sorter plate 18 with a coin opening 31 sized to restrain the 50¢ piece from entering the core and with a slot 67 for the plow 60, the plow 60, and a plurality of pins 65, one for each sorting slot 35 of the core 15. The kit could also include a discharge chute 49 and drawer 50 designed to be accommodated by the particular model of sorter being converted.

In making a conversion in the field, it is necessary to provide the cutouts 53 and 63 in the ring 20 through which the exit chute 45 extends and through which the switch actuator arm 62 projects. Alternatively, a new sorter ring could be a component part of a conversion kit.

The apparatus of the invention can also be employed to sort and count a sixth denomination of coin which is larger in size than the coins for which the sorter was originally designed. In that event, it is unnecessary to provide a new sorter plate with coin opening and also unnecessary to provide a pin 65 in each of the coin sorting slots 35.

I claim:

1. In a coin sorter including a hopper, an inclined rotating plate disposed in said hopper and having means at its periphery to carry coins one at a time to a coin opening adjacent the apex of the rotating plate, a rotating drum which receives coins at the coin opening and which sorts the coins into respective denominations by size, the improvement therein comprising:

an exit chute having an outlet disposed outside said hopper and having an entrance spaced above the surface of the rotating plate at a point beyond the apex of said plate and in the path of travel of coins carried thereon; and deflection means disposed in front of said entrance and adapted to lift coins of a size greater than the coin opening from said rotating plate and to direct the same to the entrance of the exit chute.

2. A coin sorter in accordance with claim 1, together with coin counting means including a coin sensor disposed in the path of travel of coins beyond said apex and before said entrance, said coin sensor adapted to be actuated by each coin of said size greater than the coin opening.

3. In a coin sorter including a hopper, an inclined rotatable pickup plate disposed within said hopper and having notches about its periphery each adapted to carry a single coin upwardly to a coin opening adjacent the apex of said plate, a rotatable sorting core having a plurality of sorting slots of diminishing width receiving coins passing through said coin opening, each slot having a series of projections each of which is adapted to retain a coin of a respective denomination whereby each denomination of coins which can pass through said coin opening is carried at a different level within said slots, stationary counting means disposed at each level and each adapted to be actuated by a passing coin at the level, the improvement therein comprising:

an exit chute adapted to receive coins of a size larger than can pass through said coin opening, said exit chute extending through a side of the hopper and having an entrance positioned near the surface of the pickup plate at a position beyond its apex and in the path of travel of coins carried in the notches;

a plow disposed beyond the periphery of the pickup plate and in front of the entrance, said plow extending above the surface of the pickup plate to raise coins carried by the notches and direct them into the entrance; and a switch having an actuator arm positioned between the apex of the pickup plate and the entrance of the exit chute and adapted to be contacted by coins in the notches which do not pass through said coin opening.

4. A coin sorter in accordance with claim 3, wherein said plow has an inclined leading surface which extends from beneath the surface of said pickup plate to a level above the pickup plate.

5. In a coin sorter including a shell having its axis inclined from vertical, a rotatable sorting core in said shell and having a plurality of sorting slots which diminish in width to accept given denominations of coins, each slot including means to retain a coin of a particular denomination at a respective level within said slot as the core rotates within said shell, a coin hopper extending from the front face of the shell and including a ring which encircles the shell, a stationary sorting plate within said shell above said core, a rotatable pickup plate coaxial with said core above said sorting plate and having notches at its periphery each adapted to carry a single coin upwardly and over the sorting plate to a coin opening extending along the apex of the sorting plate, the coin opening having a radial width which passes coins of said given denominations and which does not pass larger coins, the improvement therein comprising:

an exit chute adapted to receive coins of another denomination whose size is larger than said coin opening, said exit chute extending through said ring and having an entrance positioned beyond the apex and a trailing edge of said coin opening, said entrance being in the path of travel of coins carried in the notches; and a plow projecting above the surface of the pickup plate beyond the periphery thereof at a point in front of the entrance and at said trailing edge of said coin opening to raise coins carried by the notches and deflect them into said entrance.

6. A coin sorter in accordance with claim 5 together with a counting switch having an actuator arm extending through a cutout in said ring and positioned between the apex of the pickup plate and the entrance of the exit chute, said actuator arm being adapted to be contacted by each coin of said other denomination.

7. A coin sorter in accordance with claim 5 wherein said exit chute comprises a housing open at its ends and including a top, depending sides, and a bottom plate, said bottom plate being disposed in a plane slightly above the surface of said pickup plate, and a mounting flange rising from said top and secured to said ring, said housing extending through a cutout in said ring and being inclined from the horizontal so that coins can fall through the exit chute to its open outlet.

8. A coin sorter in accordance with claim 7 together with coin collection means connected to the outlet of said exit chute.

9. A coin sorter in accordance with claim 7 wherein said plow includes a ramp surface which extends outwardly from the level of the surface of said pickup plate.

10. A coin sorter conversion kit having component parts capable of being assembled to a coin sorter to increase the capacity thereof, which coin sorter includes a shell having its axis inclined from vertical, a rotatable sorting core in the shell and having a plurality of sorting slots which diminish in width to accept given denominations of coins, each slot including shelf means to retain a coin of a particular denomination at a respective level within said slot as the core rotates within said shell, a coin hopper extending from the front face of the shell and including a ring which encircles the shell, a stationary sorting plate within the shell above the core, a rotatable pickup plate coaxial with the core above the sorting plate and having notches at its periphery each adapted to carry a single coin over the surface of the sorting plate upwardly to a coin opening extending along the apex of the sorting plate, the coin opening having a radial width which passes coins of said given denominations and which does not pass larger coins, the kit comprising:

an exit chute adapted to receive coins of another denomination whose size is larger than said coin opening, said exit chute adapted to be mounted on said ring and extending through a cutout provided in said ring, said exit chute having an entrance positioned beyond the apex and a trailing edge of the coin opening so that the entrance is in the path of coins carried in the notches;

a plow adapted to be mounted to the sorter plate and to be positioned at a point in front of the entrance and at the trailing edge of the coin opening, said plow including a ramp surface which extends outwardly from the level of the surface of the pickup plate to raise coins carried by the notches and direct them into said entrance;

a replacement sorter plate adapted to be mounted in the sorter in place of the original sorter plate, said replacement sorter plate having a coin opening whose radial width is less than the size of the largest size of coin for which the sorting slots are designed; and a projection for each sorting slot and adapted to be mounted in a sorting slot to define a new shelf to reduce the width of the largest portion of the slot, whereby the sorter will additionally sort coins of a size next smaller than the largest size for which the coin sorter was designed.

11. A coin sorter conversion kit in accordance with claim 10 which further includes a counting switch adapted to be mounted on the shell and having an actuator arm adapted to extend through a cutout in said ring and to be positioned between the apex of the pickup plate and the entrance of the exit chute in the path of travel of coins carried in said notches.

* * * * *